US006020290A

United States Patent [19]

Takata et al.

[11] Patent Number: 6,020,290

[45] Date of Patent: Feb. 1, 2000

[54] GREASE COMPOSITION FOR ROLLING BEARING

[75] Inventors: Takashi Takata; Kazuo Azuma, both of Toyama-ken; Hirotugu Kinoshita, Kanagawa-ken; Souichi Nomura, Tokyo; Fumihiro Itano, Kanagawa-ken, all of Japan

[73] Assignees: Nachi-Fujikoshi Corp., Toyama-ken; Nippon Mitsubishi Oil Corporation, Tokyo, both of Japan

[21] Appl. No.: 09/334,221

[22] Filed: Jun. 16, 1999

Related U.S. Application Data

[63] Continuation-in-part of application No. 09/048,572, Mar. 26, 1998, abandoned.

[30] Foreign Application Priority Data

Mar. 31, 1997 [JP] Japan ..... 9-76731

[51] Int. Cl.[7] ..... C10M 169/06

[52] U.S. Cl. ..... 508/364

[58] Field of Search ..... 508/364, 363

[56] References Cited

U.S. PATENT DOCUMENTS

| | | | |
|---|---|---|---|
| 2,504,672 | 4/1950 | Farrington | 508/364 |
| 2,921,902 | 1/1960 | Watson | 508/364 |
| 3,933,657 | 1/1976 | Seni et al. | 508/363 |
| 5,160,645 | 11/1992 | Okaniwa et al. | 508/363 |
| 5,246,605 | 9/1993 | Vartanian | 508/363 |
| 5,512,188 | 4/1996 | Kinoshita et al. | 508/137 |
| 5,607,906 | 3/1997 | Okaniwa et al. | 508/363 |

*Primary Examiner*—Jacqueline V. Howard
*Attorney, Agent, or Firm*—Darby & Darby

[57] ABSTRACT

A grease composition for rolling bearings is disclosed which contains:

(A) 100 parts by weight of a base oil having the kinematic viscosity of 40 to 200 $mm^2/s$ at 40° C., (B) 5 to 65 parts by weight of a urea thickener, and (C) 0.05 to 10 parts by weight of zinc dithiocarbamate, the composition being free of boron nitride. This grease composition is suitable for application to rolling bearings in electrical components and accessory devices for automotive vehicles, such as alternators, electromagnetic clutches for car air conditioners, idle pulleys, electric fan motors, or the like.

7 Claims, No Drawings

GREASE COMPOSITION FOR ROLLING BEARING

CROSS-REFERENCE TO RELATED APPLICATION

This is a continuation-in-part application of U.S. patent application Ser. No. 09/048,572 filed Mar. 26, 1998, which is now abandoned.

FIELD OF THE INVENTION

The present invention relates to a grease composition for rolling bearings, in particular to a grease composition applied to rolling bearings in electrical components and accessory devices for automotive vehicles, such as alternators, electromagnetic clutches for car air conditioners, idle pulleys, electric fan motors, or the like.

BACKGROUND ART

In automotive vehicles, engine room space has necessarily been reduced for keeping up with the propagation of FF (front engine-front wheel driven) cars aiming at reduction in size and weight of the vehicles, and with the demand for increased cabin space. Accordingly, the size and weight of the electrical components and accessories such as alternators, electromagnetic clutches for car air conditioners, idle pulleys, or electric fan motors have further been reduced. At the same time, the electrical components and accessories are demanded to achieve higher performance and higher output power. Therefore, in an alternator, for example, reduction in output power caused by size reduction is compensated by increasing the designed speed. Further, to keep up with the demand for quiet operation, the degree of hermetic sealing of the engine room is advanced and hence the engine room tends to be heated, so that components capable of withstanding higher temperatures are required.

In these electrical components and accessories, rolling bearings are used, which are lubricated mainly with grease. However, there has been reported that, as the rotational speed of the bearings and the load applied to the bearings are increased due to the sever operational conditions, the service life of the rolling bearings tends to be prematurely terminated because of flaking of the race way of the bearings.

In an attempt to prevent the flaking of the race way, Japanese Laid-open Patent Application No. 3-210394 discloses a method of adding a passivating agent to the grease, and Japanese Laid-open Patent Application No. 6-803565 discloses a method of adding an antimony compound or a molybdenum compound to the grease to extend the flaking life of the race way of the bearings.

In the method of adding a passivating agent to the grease mentioned above, however, if a typical passivating agent sodium nitrite is added to a grease containing an amine antioxidant for improving the grease service life at elevated temperatures, sodium nitrite reacts with the amine antioxidant to generate a toxic N-nitrosamine compound as a by-product. Therefore, it is difficult to produce a grease which prolongs the flaking life of the race way of bearings while maintaining its service life at elevated temperatures at high level and its harmful effect on environment at low level. Further, passivating agents other than sodium nitrite, and the antimony compound and the molybdenum compound also have problems in that they contain heavy metals, which have harmful effects on human bodies as well as environment.

DISCLOSURE OF THE INVENTION

It is an object of the present invention to provide a grease composition for rolling bearings which has long service life at elevated temperatures, which has little harmful effect on human bodies and environment, and which gives excellent flaking life to the race way of bearings.

According to the present invention, there is provided a grease composition for rolling bearings comprising (A) 100 parts by weight of a base oil having a kinematic viscosity of 40 to 200 $mm^2/s$ at 40° C., (B) 5 to 65 parts by weight of a urea thickener, and (C) 0.05 to 10 parts by weight of zinc dithiocarbamate, said composition being free of boron nitride.

According to the present invention, there is also provided a grease composition for rolling bearings of the above type, wherein the base oil is a synthetic oil, and the urea thickener is a diurea compound.

According to the present invention, there is further provided a grease composition for rolling bearings of the above type, wherein the base oil is a synthetic oil selected from the group consisting of poly-α-olefins, hydrides of poly-α-olefins, polyol esters, dialkyl diphenyl ethers, and mixtures thereof.

PREFERRED EMBODIMENTS OF THE INVENTION

The grease composition of the present invention is intended for use on rolling bearings, and contains (A) a base oil having the particular kinematic viscosity (referred to as component (A) hereinbelow), (B) an urea thickener (referred to as component (B) hereinbelow), and (C) zinc dithiocarbamate (referred to as component (C) hereinbelow) at a particular mixing ratio as essential components.

The base oil as component (A) may be a mineral oil and/or a synthetic oil.

The mineral oil may be those obtained by conventional method for producing lubricating oils in the field of petroleum refining. For example, the mineral oil may be prepared by distilling crude oil under atmospheric or reduced pressure to obtain lubricant fractions, and purifying the fractions by at least one of the treatments including solvent deasphalting, solvent extraction, hydrocracking, solvent dewaxing, contact dewaxing, hydrofining, washing with sulfuric acid, and clay purification.

The synthetic oil may be a poly-α-olefin such as polybutene, a 1-octene oligomer, or a 1-decene oligomer, or a hydride of such poly-α-olefin; a diester such as ditridecyl glutarate, di-2-ethylhexyl adipate, diisodecyl adipate, ditridecyl adipate, or di-3-ethylhexyl sebacate; a polyol ester such as trimethylolpropane caprylate, trimethylolpropane pelargonate, pentaerythritol-2-ethyl hexanoate, or pentaerythritol pelargonate; alkylnaphthalene; alkylbenzene, polyoxyalkylene glycol; polyphenyl ether; dialkyl diphenyl ether; or mixtures thereof.

The synthetic oils are preferred as the component (A) for its thermostability. Among those listed above, the synthetic oils selected from the group consisting of poly-α-olefins, hydrides thereof, polyol esters, dialkyl diphenyl ethers, and mixtures thereof are particularly preferred.

The hydrides of poly-α-olefins may preferably be compounds represented by the formula (1):

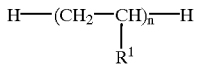

$$H-(CH_2-\underset{\underset{R^1}{|}}{CH})_n-H \quad (1)$$

wherein $R^1$ stands for a straight chain or branched alkyl group having 6 to 10 carbon atoms such as a hexyl group, a heptyl group, an octyl group, a nonyl group, or a decyl group, and n is an integer of 3 to 8.

The polyol esters may preferably be trimethylolpropane esters represented by the formula (2) or pentaerythritol esters represented by the formula (3):

(2)

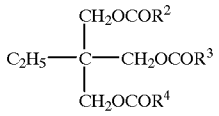

(3)

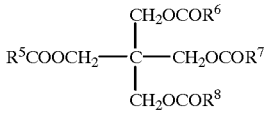

wherein $R^2$ to $R^8$ may be the same or different groups, and each stands for a straight chain or branched alkyl group having 4 to 16, preferably 6 to 14 carbon atoms such as a butyl group, a pentyl group, a hexyl group, a heptyl group, an octyl group, a nonyl group, a decyl group, an undecyl group, a dodecyl group, a tridecyl group, a tetradecyl group, a pentadecyl group, or a hexadecyl group.

The dialkyl diphenyl ethers may preferably be compounds represented by the formula (4):

(4)

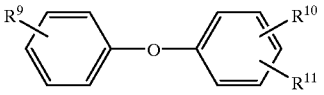

wherein $R^9$, $R^{10}$, and $R^{11}$ may be the same or different groups, and one of $R^9$, $R^{10}$, and $R^{11}$ stands for a hydrogen atom while each of the remaining two of $R^9$, $R^{10}$, and $R^{11}$ stands for an alkyl group having 8 to 20, preferably 12 to 14 carbon atoms such as an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, or an eicosyl group.

The component (A) has the kinematic viscosity of 40 to 200 $mm^2/s$, preferably 60 to 150 $mm^2/s$, at 40° C. If the kinematic viscosity of the component (A) is less than 40 $mm^2/s$, sufficiently long bearing lubricating life and race way flaking life at elevated temperatures and higher bearing rotational speed will not be achieved with the grease. If the kinematic viscosity of the component (A) exceeds 200 $mm^2/s$, the grease generates considerable amount of heat at higher bearing rotational speed, thus sufficiently long bearing lubricating life cannot be achieved.

The urea thickener as the component (B) of the grease composition of the present invention may be a diurea compound, a triurea compound, a tetraurea compound, or a polyurea compound other than diurea, triurea, and tetraurea compounds, or mixtures thereof. Among these, a diurea compound is particularly preferred, and more specifically, a diurea compound represented by the formula (5) below is the most preferred:

$$R^{12}—NHCONH—R^{13}—NHCONH—R^{14} \quad (5)$$

In the formula (5), $R^{13}$ stands for a divalent hydrocarbon residue having 6 to 20, preferably 6 to 15 carbon atoms, $R^{13}$ stands for a straight chain or branched alkylene group, a straight chain or branched alkenylene group, a cycloalkylene group, or an aromatic group, more specifically, a 2,2-dimethyl-4-methylhexylene group or any of the groups represented by the following formulae:

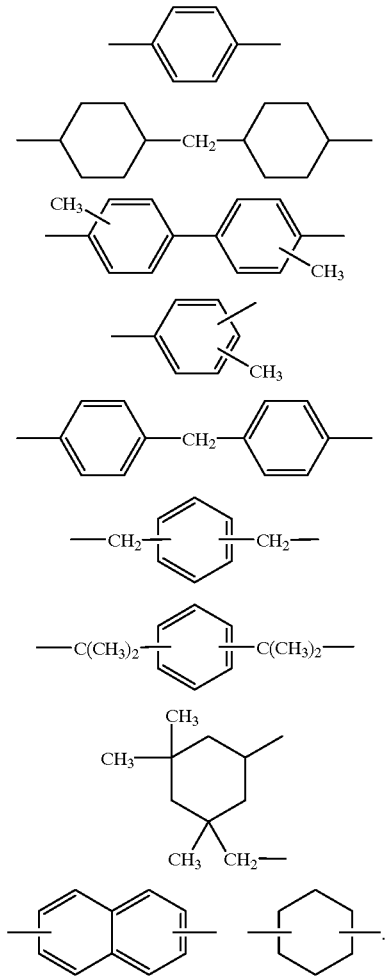

Among these,

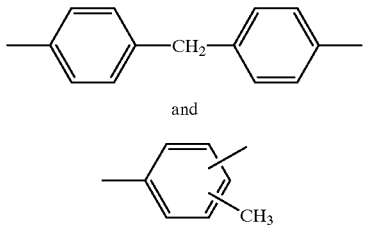

and are particularly preferred.

Further in the formula (5), $R^{12}$ and $R^{14}$ may be the same or different groups, and each stands for a hydrocarbon residue having 6 to 20, preferably 8 to 18 carbon atoms. Specifically, $R^{12}$ and $R^{14}$ each may stands for a straight chain or branched alkyl group, a straight chain or branched alkenyl group, a cycloalkyl group, an alkylcycloalkyl group, an aryl group, an alkylaryl group, or an arylalkyl group. Among these, an alkyl group, a cycloalkyl group, and an alkylaryl group are particularly preferred. Examples of $R^{12}$ and $R^{14}$ may include straight chain or branched alkyl groups such as a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, or an eicosyl group; a cyclohexyl group; alkylcycloalkyl groups such as a methylcyclohexyl group, a dimethylcyclohexyl group, an ethylcyclohexyl group, a diethylcyclohexyl group, a propylcyclohexyl group, an isopropylcyclohexyl group, a 1-methyl-3-propylcyclohexyl group, a butylcyclohexyl group, an amylcyclohexyl group, an amylmethylcyclohexyl group, a hexylcyclohexyl group, a heptylcyclohexyl group, an octylcyclohexyl group, a nonylcyclohexyl group, a decylcyclohexyl group, an undecylcyclohexyl group, a dodecylcyclohexyl group, a tridecylcyclohexyl group, or a tetradecylcyclohexyl group; aryl groups such as a phenyl group or a naphthyl group; alkylaryl groups such as a toluyl group, an ethylphenyl group, a xylyl group, a propylphenyl group, a cumenyl group, a methylnaphthyl group, an ethylnaphthyl group, a dimethylnaphthyl group, or a propylnaphthyl group; or arylalkyl groups such as a benzyl group, a methylbenzyl group, or an ethylbenzyl group. Among these, a cyclohexyl group, an octadecyl group, and a toluyl group are particularly preferred.

The method for preparing the diurea compound is not particularly limited, and the diurea compound may be prepared by reacting diisocyanate represented by the formula OCN—$R^{13}$—NCO with amines represented by the formula $R^{12}NH_2$ and $R^{14}NH_2$ in a base oil at 10 to 200° C. Here, $R^{12}$, $R^{13}$, and $R^{14}$ are the same as $R^{12}$, $R^{13}$, and $R^{14}$ in the formula (5) above.

The content of the component (B) in the grease composition of the present invention is 5 to 65 parts by weight, preferably 10 to 50 parts by weight per 100 parts by weight of the base oil as component (A). If the content of the component (B) is less than 5 parts by weight, sufficient thickening effect is not achieved, so that sufficient consistency will not be given to the grease. If the content of the component (B) exceeds 65 parts by weight, the grease may be so hard that the grease will not exhibit appropriate lubricating property.

Zinc dithiocarbamate as the component (C) in the grease composition of the present invention may be a compound represented by the formula (6):

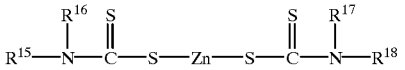

(6)

wherein $R^{15}$, $R^{16}$, $R^{17}$, and $R^{18}$ may be the same or different groups, and each stands for a hydrocarbon residue having 1 to 13, preferably 3 to 8 carbon atoms. Specifically, each of $R^{15}$, $R^{16}$, $R^{7}$, and $R^{18}$ may stand for an alkyl group, an alkenyl group, an aryl group, an alkylaryl group, or an arylalkyl group. Among these, an alkyl group is particularly preferred for preventing the race way of bearings from prematurely flaking. The alkyl group may be a straight chain or branched alkyl group, and may specifically be a straight chain or branched alkyl group having 1 to 13, preferably 3 to 8 carbon atoms such as a methyl group, an ethyl group, a propyl group, a butyl group, a pentyl group, a hexyl group, a heptyl group, an octyl group, a nonyl group, a decyl group, an undecyl group, a dodecyl group, or a tridecyl group.

Specific examples of the component (C) may include zinc dimethyldithiocarbamate, zinc diethyldithiocarbamate, zinc dipropyldithiocarbamate, zinc dibutyldithiocarbamate, zinc dipentyldithiocarbamate, zinc dihexyldithiocarbamate, zinc diheptyldithiocarbamate, zinc dioctyldithiocarbamate, zinc dinonyldithiocarbamate, zinc didecyldithiocarbamate, zinc diundecyldithiocarbamate, zinc didodecyldithiocarbamate, zinc ditridecyldithiocarbamate, and mixtures thereof.

The component (C) may be a commercially available zinc dithiocarbamate diluted with a mineral oil or kerosene. When a dilution containing the component (C) such as the commercial dilution is used, the mixing ratio of the component (C) is decided based on the net content of the component (C) in the dilution.

The content of the component (C) in the grease composition of the present invention is 0.05 to 10 parts by weight, preferably 0.25 to 5 parts by weight per 100 parts by weight of the base oil as the component (A) If the content of the component (C) is less than 0.05 parts by weight, the grease does not sufficiently prevent the flaking of race way of bearings, and the race way of bearings will prematurely flake. Even if the content of the component (C) exceeds 10 parts by weight, no further improvement is achieved in the effect of the additive, i.e. the effect of preventing flaking of the race way of bearings, thus being not economical.

The grease composition of the present invention is free of boron nitride, which results in long service life at elevated temperatures and excellent flaking life to the race way of bearings.

The grease composition of the present invention may optionally contain conventional additives as required for further improving its properties. Examples of such additives may include antioxidants such as amine-, phenol-, or sulfur-containing antioxidants, and zinc dithiophosphate; extreme-pressure agents such as chlorine-, sulfur-, or phosphorus-containing extreme-pressure agents, zinc dithiophosphate, and organic molybdenum compounds; oiliness agents such as fatty acid and animal or plant oils; rust-preventive agents such as petroleum sulfonate, dinonylnaphthalene sulfonate, and sorbitan esters; metal diactivators such as benzotriazole and benzothiadiazole; and viscosity index improvers such as polymethacrylate, polyisobutylene, and polystyrene. One or more of these additives may be contained in the present grease composition.

The grease composition of the present invention is intended for rolling bearings, especially for bearings in electrical components for automotive vehicles. More specifically, the present grease composition may preferably be used for bearings in electrical components and accessory devices for automotive vehicles such as alternators, electromagnetic clutches for car air conditioners, idle pulleys, electric fan motors, or the like.

Since the grease composition of the present invention contains the particular base oil, the urea thickener, and zinc dithiocarbamate, the grease composition exhibits the characteristic property of the urea thickener, i.e. the composition has long service life at elevated temperatures, while the grease composition has little harmful effect on human bodies and environment, and gives excellent flaking life to the race way of bearings.

EXAMPLES

The present invention will now be explained in detail with reference to Examples and Comparative Examples. However, the present invention is not limited to Examples.

Examples 1 to 6 and Comparative Examples 1 to 5

Diphenylmethane-4,4'-diisocyanate (abbreviated as MDI in the table) or tolylenediisocyanate (abbreviated as TDI in the table) as a diisocyanate was dissolved in various base oils under heating to prepare first solutions. On the other hand, various amines set forth in Table 1 were dissolved in the same kinds of base oils as in the first solutions under heating to prepare second solutions. Then the first and the second solutions were mixed to prepare gels. To the thus obtained gels, zinc dipentyldithiocarbamate having been diluted with a mineral oil to the concentration of 50 weight %, an antioxidant, and a rust-preventive agent were added. The resulting mixtures were stirred, and passed through a roll mill, thereby obtaining grease compositions of Examples 1 to 6 and Comparative Examples 1 to 4. Further, a grease composition of Comparative Example 5 was prepared in accordance with the above process except that the diisocyanate and the amine were replaced by lithium 12-hydroxystearate. The composition of the grease compositions are shown in Table 1.

The base oils used in the Examples and Comparative Examples are as follows.

1. DADPE(100 $mm^2/s$ @40° C.)

Dialkyl diphenyl ether represented by the following formula having the kinematic viscosity of 100 $mm^2/s$ at 40° C.:

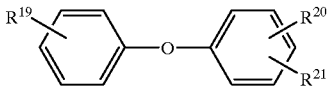

wherein $R^{19}$ to $R^{21}$ are the same or different groups, one of which stands for a hydrogen atom, and each of the remaining two of which stands for an alkyl group having 12 to 14 carbon atoms.

2. DADPE (15 $mm^2/s$ @40° C.)

Dialkyl diphenyl ether represented by the following formula having the kinematic viscosity of 15 $mm^2/s$ at 40° C.:

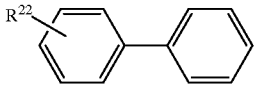

wherein $R^{22}$ stands for an alkyl group having about 12 carbon atoms.

3. PAO (50 $mm^2/s$ @40° C.)

A mixture of hydride of 1-decene oligomers represented by the following formula having the kinematic viscosity of 50 $mm^2/s$ at 40° C.:

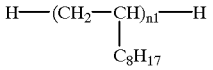

wherein $n^1$ is an integer of 3 to 5.

4. PAO (30 $mm^2/s$ @40° C.)

A mixture of hydride of 1-decene oligomers represented by the following formula having the kinematic viscosity of 30 $mm^2/s$ at 40° C.:

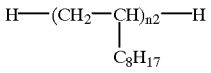

wherein $n^2$ is an integer of 2 to 5.

5. Polyol Ester

A mixture of pentaerythritol esters represented by the following formula having the kinematic viscosity of 35 $mm^2/s$ at 40° C.:

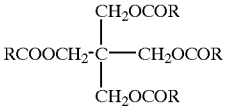

wherein R stands for an alkyl group having 7 to 12 carbon atoms.

6. Mineral Oil (80 $mm^2/s$ @40° C.)

Refined mineral oil having the kinematic viscosity of 80 $mm^2/s$ at 40° C.

7. Mineral Oil (150 $mm^2/s$ @40° C.)

Refined mineral oil having the kinematic viscosity of 150 $mm^2/s$ at 40° C.

8. Mineral Oil (750 $mm^2/s$ @40° C.)

Refined mineral Oil having the kinematic viscosity of 750 $mm^2/s$ at 40° C.

Each grease obtained above was subjected to the following tests. The results are shown in Table 1.

Mixture Consistency

The mixture consistency of each grease was measured in accordance with JIS K2220.

Quick Acceleration-Deceleration Test 1.6 g of each grease was sealed in double row angular contact ball bearings with the inner diameter of 30 mm, the outer diameter of 52 mm, and the width of 22 mm, fitted with a contact rubber seal. The bearings were run into continuous rotation at pulley load of 200 Kgf, repeating quick acceleration from the rotational speed of the bearing outer ring of 4000 rpm to 12000 rpm, and quick deceleration from 12000 rpm to 4000 rpm. Duration of the operation until the bearings started to shake due to flaking of the race way of the bearing inner ring was measured.

High Temperature-High Speed Burning Test 1.4 g of each grease was sealed in double row angular contact ball bearings with the inner diameter of 30 mm, the outer diameter of 52 mm, and the width of 22 mm, fitted with a contact rubber seal. The bearings were run into continuous rotation at a bearing outer ring rotational speed of 9000 rpm at 160° C. at the bearing load of 141 Kgf. Duration of the operation until the bearings were seized up was measured.

TABLE 1

| | | | Example | | | | | | Comparative Example | | | | |
|---|---|---|---|---|---|---|---|---|---|---|---|---|---|
| | | | 1 | 2 | 3 | 4 | 5 | 6 | 1 | 2 | 3 | 4 | 5 |
| Composition of Starting Materials for Thickener | Diisocyanate | TDI | — | — | 116.4 | 48.2 | — | — | — | — | 116.4 | 48.2 | — |
| | | MDI | 111.6 | 56.9 | — | — | 77.9 | 111.6 | 111.6 | 56.9 | — | — | — |
| | Amine | Hexamethylene-diamine | — | — | — | — | 18.2 | — | — | — | — | — | — |
| | | p-toluidine | — | — | 153.6 | — | — | — | — | — | 153.6 | — | — |

TABLE 1-continued

| | | Example | | | | | | Comparative Example | | | | |
|---|---|---|---|---|---|---|---|---|---|---|---|---|
| | | 1 | 2 | 3 | 4 | 5 | 6 | 1 | 2 | 3 | 4 | 5 |
| (g) | Cyclohexylamine | 88.4 | 31.5 | — | 27.5 | — | 88.4 | 88.4 | 31.5 | — | 27.5 | — |
| | Stearylamine | — | 36.6 | — | 74.3 | 83.9 | — | — | 36.6 | — | 74.3 | — |
| | Lithium 12-hydroxystearate | — | — | — | — | — | — | — | — | — | — | 125.0 |
| Amount of Thickener (weight %) | | 20.0 | 12.5 | 27.0 | 15.0 | 18.0 | 20.0 | 20.0 | 12.5 | 27.0 | 15.0 | 12.5 |
| Amount of Thickener (parts by weight*1) | | 28 | 16 | 41 | 20 | 24 | 28 | 28 | 15 | 40 | 20 | 16 |
| Composition of Base Oil (g) | DADPE (100 $mm^2/s$ @ 40° C.) | — | 785 | 598.5 | 370 | 592 | — | — | 815 | 469 | 370 | 785 |
| | DADPE (15 $mm^2/s$ @ 40° C.) | — | — | 66.5 | — | — | — | — | — | — | — | — |
| | PAO (50 $mm^2/s$ @ 40° C.) | 576 | — | — | — | — | — | — | — | 201 | — | — |
| | PAO (30 $mm^2/s$ @ 40° C.) | — | — | — | — | — | — | 720 | — | — | — | — |
| | Polyol ester | 144 | — | — | — | 148 | — | — | — | — | — | — |
| | Mineral Oil (80 $mm^2/s$ @ 40° C.) | — | — | — | — | — | 720 | — | — | — | — | — |
| | Mineral Oil (150 $mm^2/s$ @ 40° C.) | — | — | — | 370 | — | — | — | — | — | — | — |
| | Mineral Oil (750 $mm^2/s$ @ 40° C.) | — | — | — | — | — | — | — | — | — | 370 | — |
| Kinematic Viscosity of Base Oil ($mm^2/s$ @ 40° C.) | | 45 | 100 | 80 | 120 | 75 | 80 | 30 | 100 | 80 | 250 | 100 |
| Amount of Diluted Zinc Dithiocarbamate Added (g)*2 | | 20.0 | 30.0 | 5.0 | 50.0 | 20.0 | 20.0 | 20.0 | — | — | 50.0 | 30.0 |
| Amount of Zinc Dithiocarbamate (parts by weight*3) | | 1.4 | 1.9 | 0.4 | 3.4 | 1.4 | 1.4 | 1.4 | — | — | 3.4 | 1.9 |
| Amount of Antioxidant (g) | | 30.0 | 30.0 | 30.0 | 30.0 | 30.0 | 30.0 | 30.0 | 30.0 | 30.0 | 30.0 | 30.0 |
| Amount of Rust-preventive Agent (g) | | 30.0 | 30.0 | 30.0 | 30.0 | 30.0 | 30.0 | 30.0 | 30.0 | 30.0 | 30.0 | 30.0 |
| Mixture Consistency | | 260 | 253 | 271 | 246 | 280 | 254 | 266 | 248 | 264 | 242 | 245 |
| Quick Acceleration-Deceleration Test (hr.) | | 712 | 1413 | 1200 | 1161 | 1100 | 948 | 273 | 122 | 99 | 1210 | 86 |
| High-Temperature-High Speed Burning test (hr.) | | 1020 | 1480 | 710 | 1501 | 1512 | 850 | 1050 | 1400 | 680 | 405 | 390 |

*1Mixing ratio per 100 parts by weight of base oil
*2Zinc dithiocarbamate diluted with mineral oil to the concentration of 50 weight %
*3Net content of zinc dithiocarbamate per 100 parts by weight of base oil

Examples 7 and 8

Diphenylmethane-4,4'-diisocyanate (MDI) was dissolved in base oils shown in Table 2 under heating to prepare first solutions. On the other hand, amines shown in Table 2 were dissolved in the same base oils as in the first solutions under heating to prepare second solutions. Then each of the first solutions and the second solutions were mixed to prepare gels. To the obtained gels, zinc dipentyldithiocarbamate having been diluted with a mineral oil to the concentration of 50wt%, an antioxidant, and a rust-preventing agent were added. The resulting mixtures were stirred and passed through a roll mill, thereby obtaining grease compositions 7 and 8 of the present invention.

The obtained grease compositions were subjected to the quick acceleration-deceleration test and the high temperature-high speed burning test in the same conditions as Examples 1 to 6. The results are shown in Table 2.

Comparative Example 6

Example 7 was followed except that boron nitride powders having an average particle size of 0.7 μm were further added to the mixture. The composition thereof and test results therefor are shown in Table 2.

Comparative Example 7

Example 8 was followed except that boron nitride powders having an average particle size of 1.6 μm were further added to the mixture. The composition thereof and test results therefor are shown in Table 2.

Comparative Example 8

Example 7 was followed except that zinc di-n-propyldithiophosphate was employed instead of zinc dipentyldithiocarbamate. The composition thereof and test results therefor are shown in Table 2.

TABLE 2

| | | | Example | | Comp. Examples | | |
|---|---|---|---|---|---|---|---|
| | | | 7 | 8 | 6 | 7 | 8 |
| Starting Material for Thickener (g) | Diisocyanate | MDI | 111.6 | 63.7 | 111.6 | 63.7 | 111.6 |
| | Amines | Cyclohexyl-amine | 88.4 | 35.3 | 88.4 | 35.3 | 88.4 |
| | | Stearyl-amine | — | 41.0 | — | 41.0 | — |
| Thickener (parts by weight#1) | | | 28 | 18 | 28 | 18 | 28 |
| Base Oil (g) | DADPE | | — | 616.0 | — | 616.0 | — |
| | PAO | | 576.0 | — | 576.0 | — | 576.0 |
| | Polyol Ester | | 144.0 | 154.0 | 144.0 | 154.0 | 144.0 |
| Kinematic Viscosity of Base Oil ($mm^2s$, @ 40° C.) | | | 45 | 75 | 45 | 75 | 45 |
| Diluted Zinc Dithiocarbamate Added#2 (g) | | | 20.0 | 30.0 | 20.0 | 30.0 | — |
| Zinc Dithiocarbamate (parts by weight#3) | | | 1.4 | 1.9 | 1.4 | 1.9 | — |

TABLE 2-continued

| | Example | | Comp. Examples | | |
|---|---|---|---|---|---|
| | 7 | 8 | 6 | 7 | 8 |
| Boron Nitride Av. Particle Size 0.7 μm | — | — | 20.0 | — | — |
| Powders (g) Av. Particle Size 1.6 μm | — | — | — | 50.0 | — |
| Diluted Zinc Dithiophosphate Added[#4] (g) | — | — | — | — | 20.0 |
| Zinc Dithiophosphate (parts by weight[#5]) | — | — | — | — | 1.4 |
| Antioxidant (g) | 30.0 | 30.0 | 30.0 | 30.0 | 30.0 |
| Rust-preventing Agent (g) | 30.0 | 30.0 | 30.0 | 30.0 | 30.0 |
| Quick Acceleration-Deceleration Test (hr) | 730 | 1320 | 95 | 40 | 480 |
| High Temperature-High Speed Burning Test (hr) | 1100 | 1580 | 260 | 110 | 770 |

[#1]Mixing ratio per 100 parts by weight of base oil
[#2]Zinc dithiocarbamate diluted with mineral oil to the cnocentration of 50 wt %
[#3]Net content of zinc dithiocarbamate per 100 parts by weight of base oil
[#4]Zinc dithiophosphate diluted with mineral oil to the concentration of 50 wt %
[#5]Net content of zinc dithiophosphate per 100 parts by weight of base oil Although the present invention has been described with reference to the preferred examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A grease composition for rolling bearings comprising:

(A) 100 parts by weight of a base oil having a kinematic viscosity of 40 to 200 $mm^2/s$ at 40° C., (B) 5 to 65 parts by weight of a urea thickener, and (C) 0.05 to 10 parts by weight of zinc dithiocarbamate, said composition being free of boron nitride.

2. The grease composition as claimed in claim 1 wherein said base oil (A) having kinematic viscosity of 40 to 200 $mm^2/s$ at 40° C. is selected from the group consisting of a mineral oil, a synthetic oil, and mixtures thereof.

3. The grease composition as claimed in claim 1 wherein said urea thickener (B) is selected from the group consisting of a diurea compound, a triurea compound, a tetraurea compound, a polyurea compound, and mixtures thereof.

4. The grease composition as claimed in claim 1 wherein said zinc dithiocarbamate (C) is selected from the group consisting of zinc dimethyldithiocarbamate, zinc diethyldithiocarbamate, zinc dipropyldithiocarbamate, zinc dibutyldithiocarbamate, zinc dipentyl-dithiocarbamate, zinc dihexyldithiocarbamate, zinc diheptyldithiocarbamate, zinc dioctyldithiocarbamate, zinc dinonyldithiocarbamate, zinc didecyl-dithiocarbamate, zinc diundecyldithiocarbamate, zinc didodecyldithiocarbamate, zinc ditridecyldithiocarbamate, and mixtures thereof.

5. The grease composition as claimed in claim 1 wherein said base oil (A) having kinematic viscosity of 40 to 200 $mm^2/s$ at 40° C. is a synthetic oil, and said urea thickener (B) is a diurea compound.

6. The grease composition as claimed in claim 2 wherein said synthetic oil is selected from the group consisting of poly-α-olefins, hydrides of poly-α-olefins, polyol esters, dialkyl diphenyl ethers, and mixtures thereof.

7. The grease composition as claimed in claim 1 further comprising an additive selected from the group consisting of a n antioxidant, an extreme-pressure agent, an oiliness agent, a rust-preventive agent, a metal diactivator, a viscosity index improver, and mixtures thereof.

* * * * *

UNITED STATES PATENT AND TRADEMARK OFFICE

CERTIFICATE OF CORRECTION

PATENT NO. : 6,020,290

DATED : February 1, 2000

INVENTOR(S) : Takashi Takata et al.

It is certified that errors appear in the above-identified patent and that said Letters Patent is hereby corrected as shown below:

Title page, [30] Foreign Application Priority Data, change

"9-76731" to --9-79731--.

Signed and Sealed this

Twenty-first Day of November, 2000

*Attest:*

Q. TODD DICKINSON

*Attesting Officer*

*Director of Patents and Trademarks*